US006257102B1

(12) United States Patent
Perry

(10) Patent No.: US 6,257,102 B1
(45) Date of Patent: Jul. 10, 2001

(54) EXTENSION ATTACHMENT FOR WRENCHES

(76) Inventor: Kevin Perry, 90 N. Church St., Bremen, KY (US) 42325

( * ) Notice: Subject to any disclaimer, the term of this patent is extended or adjusted under 35 U.S.C. 154(b) by 0 days.

(21) Appl. No.: 09/569,625

(22) Filed: May 12, 2000

(51) Int. Cl.[7] ..... B25B 23/16
(52) U.S. Cl. ..... 81/177.2; 81/177.1
(58) Field of Search ..... 81/177.1, 177.2

(56) References Cited

U.S. PATENT DOCUMENTS

| | | | | |
|---|---|---|---|---|
| D. 328,017 | | 7/1992 | Boeke et al. . | |
| D. 394,992 | | 6/1998 | Landin . | |
| 1,511,738 | * | 10/1924 | Lownsbery | 81/177.2 |
| 1,689,639 | * | 10/1928 | Neff | 81/177.2 |
| 4,644,600 | | 2/1987 | Fugate . | |
| 4,729,281 | | 3/1988 | Holloway, Jr. . | |
| 4,960,014 | | 10/1990 | Kelley . | |
| 5,168,782 | | 12/1992 | Cromwell . | |
| 5,570,617 | | 11/1996 | Love . | |
| 5,832,794 | * | 11/1998 | Fowler | 81/177.2 |

* cited by examiner

*Primary Examiner*—James G. Smith

(57) ABSTRACT

An extension attachment for wrenches for allowing the user to reach hard-to-reach areas of an object to either tighten or loosen screws or nuts therefrom. The extension attachment for wrenches includes an elongate support member having a handle member and a wrench support member attached to the handle member and having a first end, a second end, a first planar side and a second planar side with the elongate support member also including flange members extending along either edge of the first planar side and being spaced apart to receive and retain a portion of a wrench therebetween; and also includes a fastening assembly for fastening a wrench to the wrench support member.

13 Claims, 2 Drawing Sheets

EXTENSION ATTACHMENT FOR WRENCHES

BACKGROUND OF THE INVENTION

1. Field of the Invention

The present invention relates to a wrench extension tool and more particularly pertains to a new extension attachment for wrenches for allowing the user to reach hard-to-reach areas of an object to either tighten or loosen screws or nuts therefrom.

2. Description of the Prior Art

The use of a wrench extension tool is known in the prior art. More specifically, a wrench extension tool heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,570,617; U.S. Pat. No. 4,729,281; U.S. Pat. No. 5,168,782; U.S. Pat. No. 4,960,014; U.S. Pat. No. Des. 394,992; and U.S. Pat. No. 4,644,600.

While these devices fulfill their respective, particular objectives and requirements, the aforementioned patents do not disclose a new extension attachment for wrenches. The inventive device includes an elongate support member having a handle member and a wrench support member attached to the handle member and having a first end, a second end, a first planar side and a second planar side with the elongate support member also including flange members extending along either edge of the first planar side and being spaced apart to receive and retain a portion of a wrench therebetween; and also includes a fastening assembly for fastening a wrench to the wrench support member.

In these respects, the extension attachment for wrenches according to the present invention substantially departs from the conventional concepts and designs of the prior art, and in so doing provides an apparatus primarily developed for the purpose of allowing the user to reach hard-to-reach areas of an object to either tighten or loosen screws or nuts therefrom.

SUMMARY OF THE INVENTION

In view of the foregoing disadvantages inherent in the known types of wrench extension tool now present in the prior art, the present invention provides a new extension attachment for wrenches construction wherein the same can be utilized for allowing the user to reach hard-to-reach areas of an object to either tighten or loosen screws or nuts therefrom.

The general purpose of the present invention, which will be described subsequently in greater detail, is to provide a new extension attachment for wrenches which has many of the advantages of the wrench extension tool mentioned heretofore and many novel features that result in a new extension attachment for wrenches which is not anticipated, rendered obvious, suggested, or even implied by any of the prior art wrench extension tool, either alone or in any combination thereof.

To attain this, the present invention generally comprises an elongate support member having a handle member and a wrench support member attached to the handle member and having a first end, a second end, a first planar side and a second planar side with the elongate support member also including flange members extending along either edge of the first planar side and being spaced apart to receive and retain a portion of a wrench therebetween; and also includes a fastening assembly for fastening a wrench to the wrench support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new extension attachment for wrenches which has many of the advantages of the wrench extension tool mentioned heretofore and many novel features that result in a new extension attachment for wrenches which is not anticipated, rendered obvious, suggested, or even implied by any of the prior art wrench extension tool, either alone or in any combination thereof.

It is another object of the present invention to provide a new extension attachment for wrenches which may be easily and efficiently manufactured and marketed.

It is a further object of the present invention to provide a new extension attachment for wrenches which is of a durable and reliable construction.

An even further object of the present invention is to provide a new extension attachment for wrenches which is susceptible of a low cost of manufacture with regard to both materials and labor, and which accordingly is then susceptible of low prices of sale to the consuming public, thereby making such extension attachment for wrenches economically available to the buying public.

Still yet another object of the present invention is to provide a new extension attachment for wrenches which provides in the apparatuses and methods of the prior art some of the advantages thereof, while simultaneously overcoming some of the disadvantages normally associated therewith.

Still another object of the present invention is to provide a new extension attachment for wrenches for allowing the user to reach hard-to-reach areas of an object to either tighten or loosen screws or nuts therefrom.

Yet another object of the present invention is to provide a new extension attachment for wrenches which includes an elongate support member having a handle member and a wrench support member attached to the handle member and having a first end, a second end, a first planar side and a second planar side with the elongate support member also including flange members extending along either edge of the first planar side and being spaced apart to receive and retain a portion of a wrench therebetween; and also includes a fastening assembly for fastening a wrench to the wrench support member.

Still yet another object of the present invention is to provide a new extension attachment for wrenches that easily and conveniently allows a user to attach a wrench thereto.

Even still another object of the present invention is to provide a new extension attachment for wrenches that is easy to use and access those hard-to-reach areas of objects.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
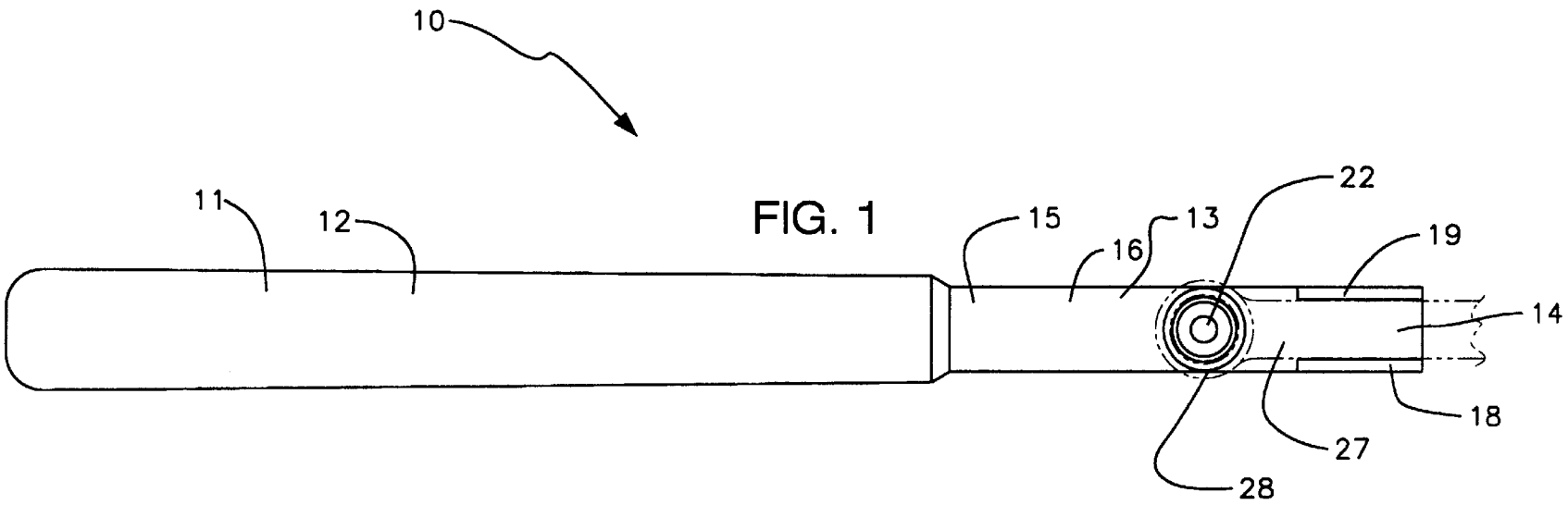
FIG. 1 is a top plan view of a new extension attachment for wrenches according to the present invention.
Figure 2:
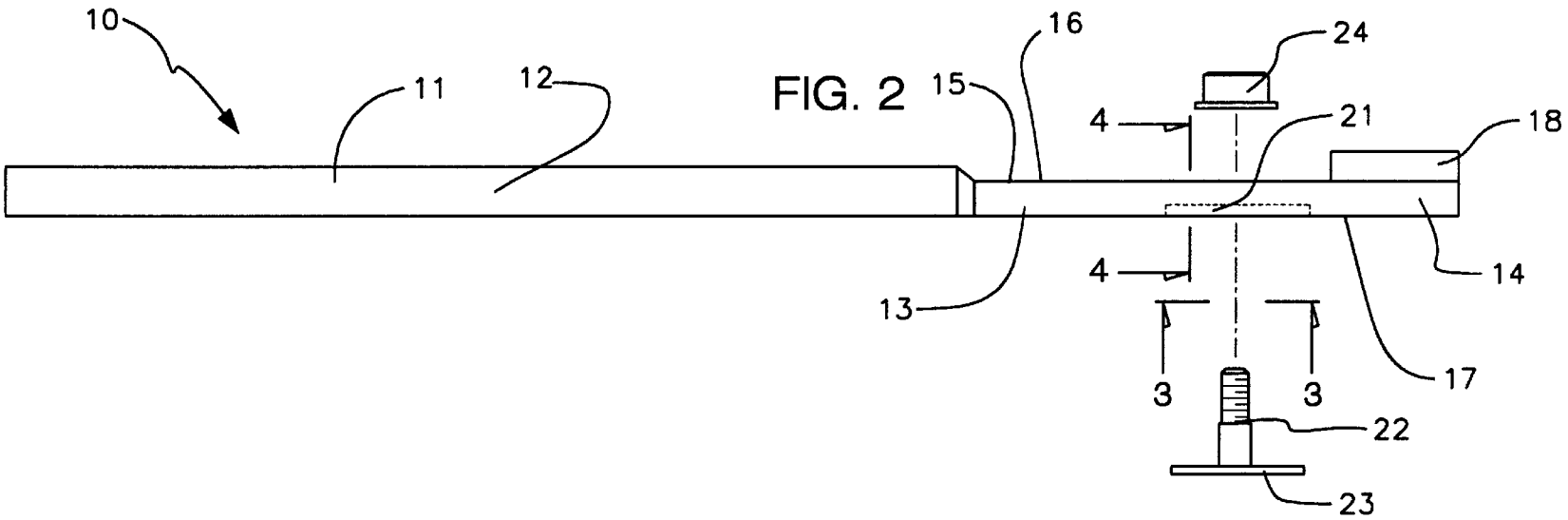
FIG. 2 is an exploded side elevational view of the present invention.
Figure 3:
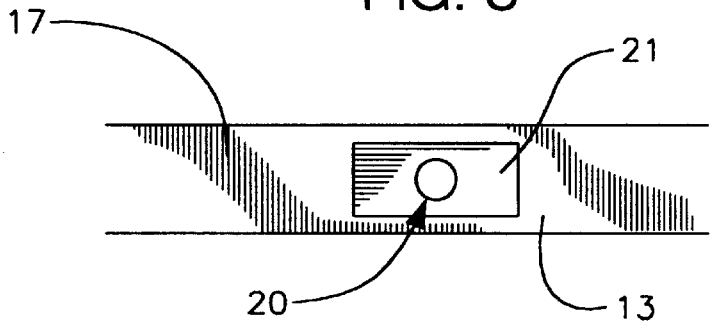
FIG. 3 is a detailed bottom plan view of the recessed portion of the present invention.
Figure 4:
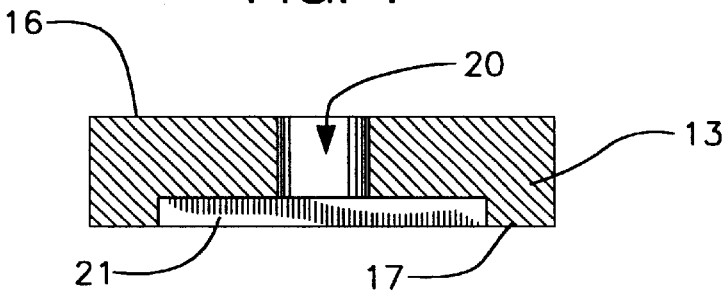
FIG. 4 is a detailed cross-sectional view of the opening through the wrench support member of the present invention.
Figure 5:
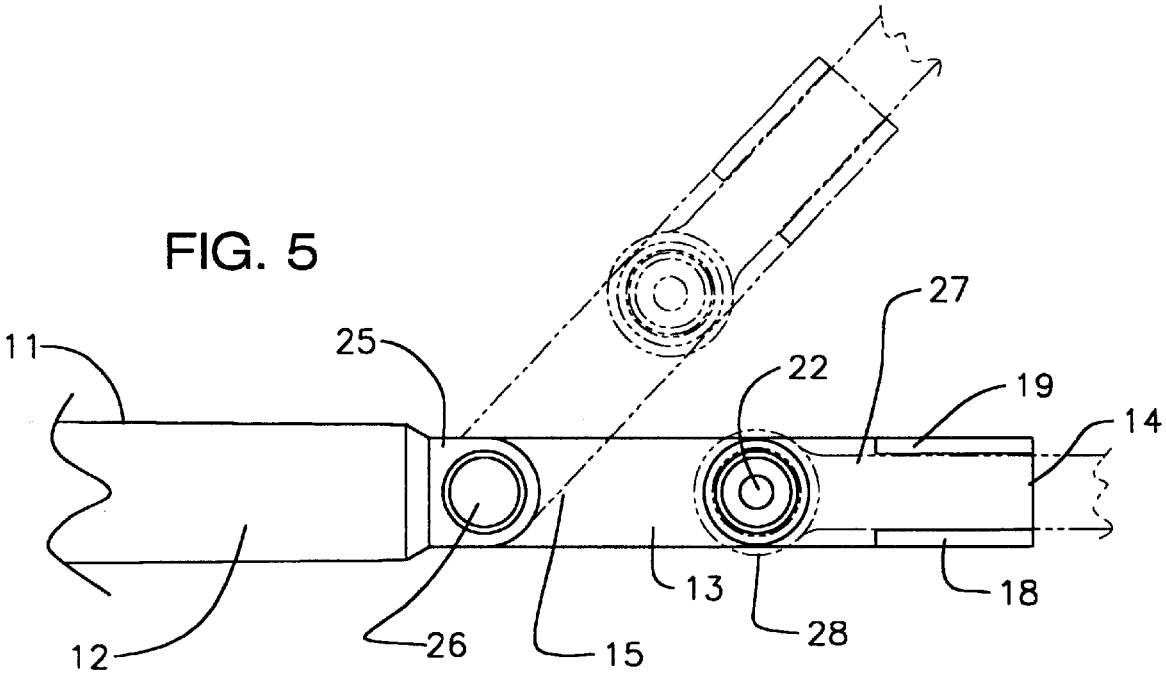
FIG. 5 is a top plan view of a second embodiment of the present invention.

With reference now to the drawings, and in particular to FIGS. 1 through 5 thereof, a new extension attachment for wrenches embodying the principles and concepts of the present invention and generally designated by the reference numeral 10 will be described.

As best illustrated in FIGS. 1 through 5, the extension attachment for wrenches 10 generally comprises an elongate support member 11 having a handle member 13 and a wrench support member 13 attached to the handle member 12 and having a first end 14, a second end 15, a first planar side 16 and a second planar side 17. The elongate support member 11 also includes flange members 18,19 conventionally extending along either edge of the first planar side 16 and being spaced apart. The flange members 18,19 extend from the first end 14 and along a portion of the wrench support member 13 and also extend outwardly of the first planar side 16. The flange members 18,19 are adapted to receive and retain a portion of a wrench 27 therebetween with the wrench support member 13 including a recess portion 21 extending in the second planar side 17 intermediate of the first end 14 and the second end 15 thereof and also including an opening 20 centrally-disposed through the recess portion 21 and extending through the sides 16,17 of the wrench support member 13. The elongate support member 11 has a length of approximately 16 inches. Means for fastening a wrench 27 to the wrench support member 13 includes a threaded shaft member 22 having a head portion 23 conventionally disposed at one end thereof, and also includes a threaded nut member 24 being adapted to thread upon the shaft member 23 to securely fasten the wrench 27 to the first planar side 16 of the wrench support member 13. The shaft member 22 is adapted to extend through the opening 20 of the wrench support member 13 and through an end portion 28 of the wrench 27 with the recessed portion 21 of the wrench support member 13 being adapted to receive the head portion 23 of the shaft member 22.

As a first embodiment, the second end 15 of the wrench support member 13 is integrally attached to handle member 12.

As a second embodiment, the second end 15 of the wrench support member 13 is pivotally attached with a fastener 26 to an end 25 of the handle member 12 to allow the wrench support member 13 to pivot relative to the handle member 12.

In use, the user takes a conventional wrench 27 having a claw-like end and a closed end 28 with a hole therethrough and places a portion of the wrench 27 between the flange members 18,19 and extends the shaft member 22 through the end 28 of the wrench 27 and through the opening 20 in the wrench support member 13 and securely tightens the nut member 24 to the shaft member 22 to securely fasten the wrench 27 to the elongate support member 11 which allows the user to reach hard-to-reach areas in order to either loosen or tighten nuts or screws from the particular objects.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extension attachment for wrenches comprising:

an elongate support member having a handle member and a wrench support member attached to said handle member and having a first end, a second end, a first planar side and a second planar side, said elongate support member also including flange members extending along either edge of said first planar side and being spaced apart;

means for fastening a wrench to said wrench support member;

wherein said flange members extend from said first end and along a portion of said wrench support member and also extend outwardly of said first planar side;

wherein said flange members are adapted to receive and retain a portion of a wrench therebetween;

wherein said wrench support member includes a recess portion extending in said second planar side intermediate of said first end and said second end thereof, and also includes an opening centrally-disposed through said recess portion and extending through said sides of said wrench support member;

wherein said means for fastening a wrench to said wrench support member includes a threaded shaft member having a head portion disposed at one end thereof and also includes a threaded nut member being adapted to thread upon said shaft member to securely fasten the wrench to said first planar side of said wrench support member;

wherein said shaft member is adapted to extend through said opening of said wrench support member and through an end portion of the wrench; and wherein said recess portion of said wrench support member is adapted to receive said head portion of said shaft member.

2. An extension attachment for wrenches as described in claim 1, wherein said second end of said wrench support member is integrally attached to handle member.

3. An extension attachment for wrenches as described in claim 1, wherein second end of said wrench support member is pivotally attached with a fastener to an end of said handle member to allow said wrench support member to pivot relative to said handle member.

4. An extension attachment for wrenches comprising:

an elongate support member having a handle member and a wrench support member attached to said handle member and having a first end, a second end, a first planar side and a second planar side, said elongate support member also including flange members extending along either edge of said first planar side and being spaced apart, said flange members extending from said first end and along a portion of said wrench support member and also extending outwardly of said first planar side, said flange members being adapted to receive and retain a portion of a wrench therebetween, said wrench support member including a recess portion extending in said second planar side intermediate of said first end and said second end thereof, and also including an opening centrally-disposed through said recess portion and extending through said sides of said wrench support member, said elongate support member having a length of approximately 16 inches; and means for fastening a wrench to said wrench support member including a threaded shaft member having a head portion disposed at one end thereof and also including a threaded nut member being adapted to thread upon said shaft member to securely fasten the wrench to said first planar side of said wrench support member, said shaft member being adapted to extend through said opening of said wrench support member and through an end portion of the wrench, said recess portion of said wrench support member being adapted to receive said head portion of said shaft member.

5. An extension attachment for wrenches as described in claim 4, wherein said second end of said wrench support member is integrally attached to handle member.

6. An extension attachment for wrenches as described in claim 4, wherein second end of said wrench support member is pivotally attached with a fastener to an end of said handle member to allow said wrench support member to pivot relative to said handle member.

7. An extension attachment for wrenches comprising:

an elongate support member having a handle member and a wrench support member attached to said handle member and having a first end, a second end, a first planar side and a second planar side, said elongate support member also including flange members extending along either edge of said first planar side and being spaced apart;

means for fastening a wrench to said wrench support member;

said wrench support member including a recess portion extending in said second planar side intermediate of said first end and said second end thereof, and also includes an opening centrally-disposed through said recess portion and extending through said sides of said wrench support member; and said recess portion of said wrench support member being adapted to receive said head portion of said shaft member.

8. An extension attachment for wrenches as described in claim 7, wherein said flange members extend from said first end and along a portion of said wrench support member and also extend outwardly of said first planar side.

9. An extension attachment for wrenches as described in claim 7, wherein said flange members are adapted to receive and retain a portion of a wrench therebetween.

10. An extension attachment for wrenches as described in claim 7, wherein said means for fastening a wrench to said wrench support member includes a threaded shaft member having a head portion disposed at one end thereof and also includes a threaded nut member being adapted to thread upon said shaft member to securely fasten the wrench to said first planar side of said wrench support member.

11. An extension attachment for wrenches as described in claim 10, wherein said shaft member is adapted to extend through said opening of said wrench support member and through an end portion of the wrench.

12. An extension attachment for wrenches as described in claim 11, wherein said second end of said wrench support member is integrally attached to handle member.

13. An extension attachment for wrenches as described in claim 7, wherein second end of said wrench support member is pivotally attached with a fastener to an end of said handle member to allow said wrench support member to pivot relative to said handle member.

* * * * *